United States Patent [19]

Penn

[11] 4,047,854

[45] Sept. 13, 1977

[54] METERING PISTON PUMP WITH PISTON-CARRIED DISTRIBUTOR FOR VISCOUS FLUID

[76] Inventor: Laurence Richard Penn, 18 Church Mount, Guilsborough, Northampton, England

[21] Appl. No.: 602,547

[22] Filed: Aug. 7, 1975

[30] Foreign Application Priority Data

May 27, 1975 United Kingdom ..... 23106/75

[51] Int. Cl.[2] ..... F04B 7/04; F04B 39/10; F04B 15/02

[52] U.S. Cl. ..... 417/489; 417/511; 417/900; 222/383

[58] Field of Search ..... 417/489, 511, 900, 490, 417/306; 222/383, 256

[56] References Cited

U.S. PATENT DOCUMENTS

| | | | |
|---|---|---|---|
| 1,336,187 | 4/1920 | Barr | 222/383 |
| 1,798,209 | 3/1931 | Lambert | 417/511 |
| 2,384,824 | 9/1945 | Eitner | 222/256 |
| 2,464,030 | 3/1949 | Engstrom | 417/511 |
| 2,531,705 | 11/1950 | Schultz | 60/584 |
| 2,569,903 | 10/1951 | Santarelli | 417/489 |
| 3,153,385 | 10/1964 | Baron-Bowen | 417/489 |
| 3,802,805 | 4/1974 | Roeser | 417/398 |

FOREIGN PATENT DOCUMENTS

| | | | |
|---|---|---|---|
| 710,293 | 8/1931 | France | 417/489 |
| 1,357,961 | 6/1974 | United Kingdom | 417/489 |

*Primary Examiner*—Carlton R. Croyle
*Assistant Examiner*—Thomas I. Ross
*Attorney, Agent, or Firm*—Kurt Kelman

[57] ABSTRACT

A material dispensing and metering piston pump comprising, in combination, a piston cylinder, an inlet defined in said cylinder for material to be dispensed, and an outlet defined in said cylinder for the said material, the inlet and the outlet being axially spaced from one another, and a piston comprising a piston rod and a piston head, the piston head comprising a member having a peripheral skirt outwardly and forwardly projecting therefrom, said member having one or more apertures extending there-through, there being a sealing member mounted on said piston rod, said member and said sealing member being movable relative to one another, said sealing member acting to seal said apertures when said member with said peripheral skirt and said sealing member are in one relative terminal position, the arrangement being such that the member and sealing member co-operate to seal said apertures when the piston head assembly moves material towards said outlet and to open said apertures when the piston head is withdrawn from said cylinder.

1 Claim, 4 Drawing Figures

METERING PISTON PUMP WITH PISTON-CARRIED DISTRIBUTOR FOR VISCOUS FLUID

Figure 1:
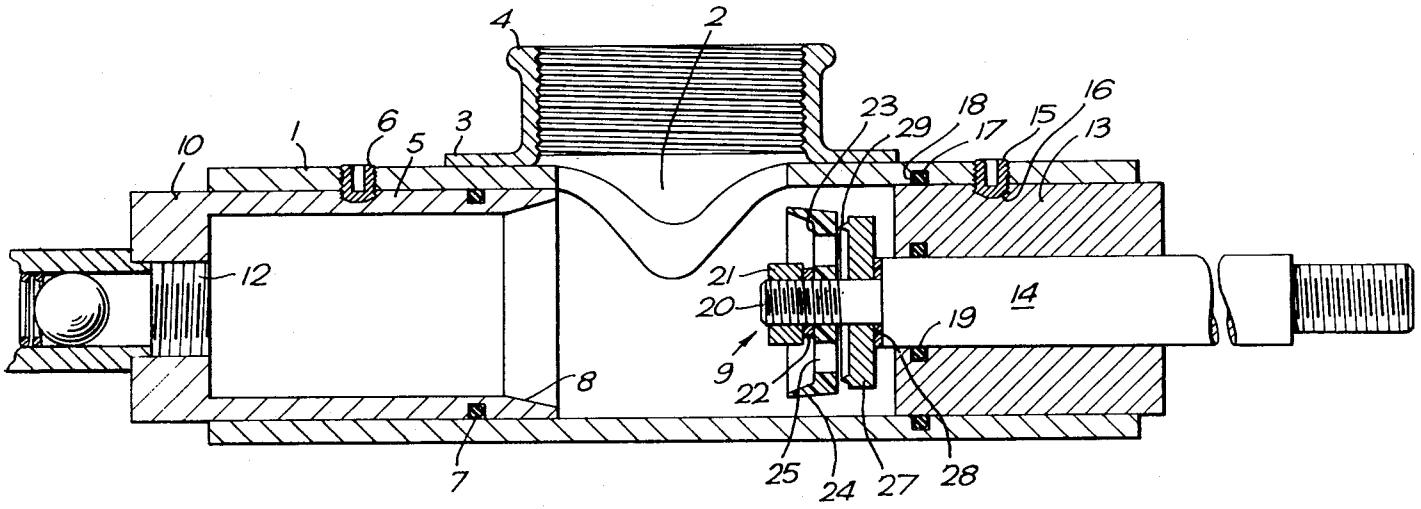

This invention relates to piston pumps for pumping and metering, particularly materials having moderate or high viscosities, including thixotropic materials.

Hitherto, problems have frequently been encountered in the use of piston pumps for pumping and metering materials, particularly viscous materials such as resins and pastes, generally due to incomplete loading of the materials in the piston cylinder prior to ejection therefrom by the piston. Such incomplete loading of the materials may well lead to inaccurate metering. In order to overcome such problems piston pumps have been cycled very slowly, or have been pressure fed with the material to be pumped and metered. Such pumps generally include a pressure supply line and a nonreturn valve communicating with a cylinder of the pump.

Many prior proposed piston pumps comprise a piston having a head which is movable within a cylinder, which head moves in and out of the cylinder during an operational cycle of the pump. In such a pump, an inlet for fluid to be pumped and/or metered is located adjacent one end of the cylinder, and as the piston is withdrawn from the cylinder a partial vacuum is generated within the cylinder which partial vacuum tends to draw material to be pumped into the cylinder when the piston passes the inlet. The replenishment of material in the cylinder is aided by the "ram" effect of the piston during the following stroke of the piston. However, the charging efficiency of such a pump is dependent upon the cycle rate and the viscosity/thixotropy of the material being pumped. Furthermore, when pumping and metering materials which have a low flash point or materials which are chemically unstable e.g. which are affected detrimentally by shock, the partial vacuum generated by the piston when the piston is withdrawn from the cylinder may cause vaporisation or chemical change of the material being pumped.

The present invention seeks to provide a piston pump which overcomes, or at least reduces the above described problems. Thus the invention aims to provide a pump which can, in use, reliably provide substantially uniform metered quantities of material, including even highly viscous materials.

According to one aspect of this invention there is provided a material dispensing and metering piston pump comprising in combination, a piston cylinder, an inlet defined in said cylinder for material to be dispensed, and an outlet defined in said cylinder for the said material, the inlet and the outlet being axially spaced from one another, and a piston comprising a piston rod and a piston head, the piston head comprising a member having a peripheral skirt outwardly and forwardly projecting therefrom, said member having one or more apertures extending there-through, there being a sealing member mounted on said piston rod, said member and said sealing member being movable relative to one another, said sealing member acting to seal said apertures when said member with said peripheral skirt and said sealing member are in one relative terminal position, the arrangement being such that the member and sealing member co-operate to seal said apertures when the piston head assembly moves material towards said outlet and to open said apertures when the piston head is withdrawn from said cylinder.

According to a preferred embodiment of this invention, there is provided a chamfered region within the piston cylinder adjacent the inlet, and the peripheral skirt projects for engagement with the said chamfered region of the cylinder.

Advantageously the member having the peripheral skirt is movably connected to said piston rod.

Conveniently the piston rod and head are movable so that the piston head is movable axially within the piston cylinder between a first terminal position adjacent the outlet and a second terminal position adjacent the inlet, at least a portion of the inlet being located between said first and second terminal positions of the piston head, the piston head being movable axially out of the piston cylinder and to the area of the inlet aperture for charging material into the piston cylinder for discharge via the outlet.

Figure 2:
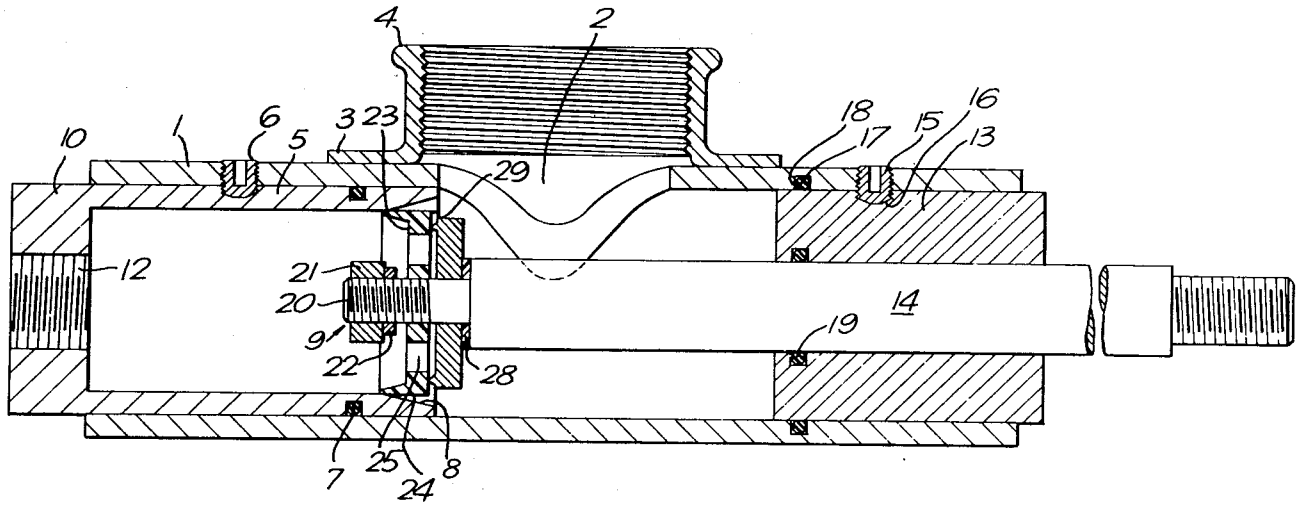
Figure 3:
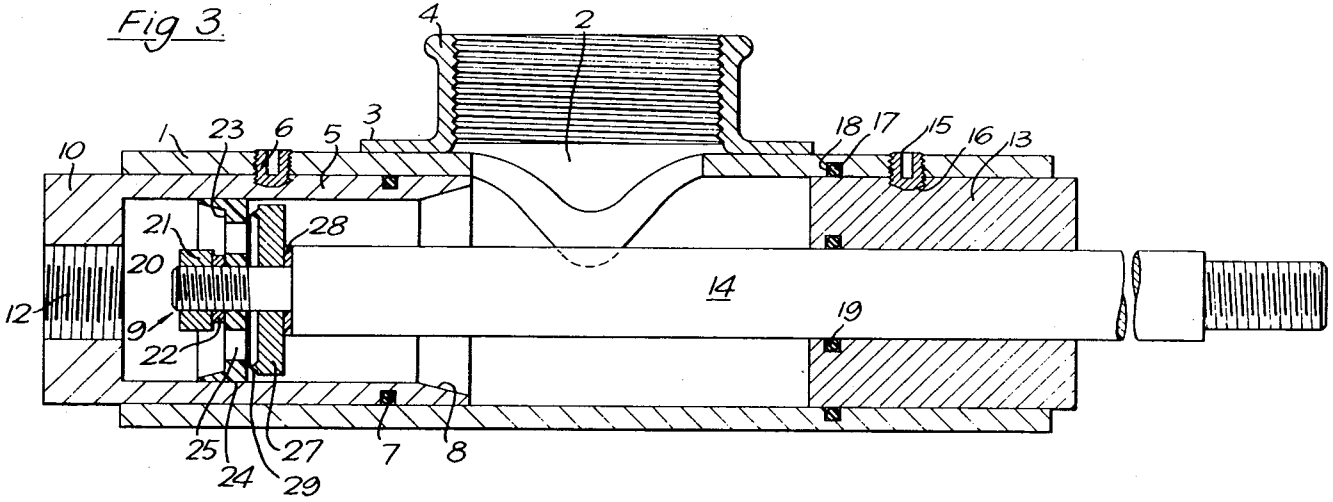
Figure 4:
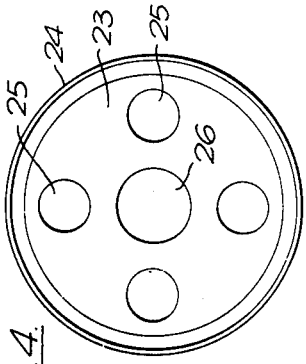

In order that the invention may be more readily understood and so that further features thereof may be appreciated, the invention will now be described by way of example with reference to the accompanying drawings in which:

FIGS. 1 to 3 are cross-sectional views of one embodiment of a pump in accordance with the invention at various times during an operational cycle, and FIG. 4 is an elevational view of part of the piston head member of the pump shown in FIGS. 1 to 3.

Referring to the drawings a pump in accordance with the present invention comprises a tubular body 1 formed by a mild steel tube of uniform circular internal cross section throughout. The body has an inlet aperture 2 in a side wall thereof, and a collar 3 is disposed around the body having an internally screw threaded upstanding radially disposed hollow and circular flange 4 which is co-aligned with the aperture 2 to permit connection to a pipe or container containing the material which is to be drawn into the interior of the body via the aperture in the body.

A tubular or cylindrical sleeve 5 being circular in internal and external cross section lies within the body 1 and defines a portion of a piston cylinder.

The inner surface of the sleeve may be coated with PTFE (polytetrafluoroethylene), and the outer surface of the sleeve is in intimate contact with part of the inner surface of the body 1 and is located axially to one side of the aperture 2. The sleeve 5 is rigidly connected to the body by grub screws 6 extending through radially disposed screw threaded bores in the wall of the body and engaging in recesses in the sleeve and at least one O-ring 7 for sealing (conveniently made of a rubber or plastics material such as PTFE) is disposed between the body 1 and the sleeve 5 in a circumferential locating groove which is formed in the sleeve.

The internal surface 8 of an end portion of the sleeve 5 located nearest the aperture 2 is steeply chamfered to provide a guide surface and mechanical closure ramp for a piston head assembly 9 which will be described in greater detail hereinafter. The end portion of the sleeve 5 remote from the aperture 2 has an inwardly directed thick annular flange 10 which defines an outlet 12, this flange 10 being internally screw threaded to provide an outlet for connection to an outlet pipe, which in turn may be coupled to a non-return valve. Clearly the non-return valve could be directly coupled to the threaded outlet.

Located at the opposite end of the body 1 to the outlet 12 is a cylindrical bearing 13 for a piston rod 14, this bearing 13 being secured within the body 1 by a grub screw 15 which passes through a radially extending internally threaded bore provided in the wall of the body 1, and which engages with a corresponding recess 16 provided in the cylindrical bearing. An O-ring 17 is disposed between the body and the cylindrical bearing, and is accommodated within a groove 18 formed on the interior surface of the body 1. The bearing 13 comprises an axially bored sleeve internally rebated to locate a sealing O-ring 19. The piston rod 14 extends through the axial bore of the bearing 13 and is embraced by the O-ring 19. Various locating elements and a lubricant conduit may be provided to enable the bearing to be lubricated periodically (not shown).

One end portion 20 of the piston rod 14 which is to the side of the bearing adjacent the chamfered sleeve is provided with a piston head assembly 9, the portion 20 of the piston rod supporting the piston head assembly being of lesser diameter than the portion of the piston rod 14 accommodated within said cylindrical bearing 13. The terminal region of this portion 20 of the piston rod of lesser diameter is provided with external threads and the piston head assembly is retained in position by means of a locking nut 21 which is secured to said threaded region of the piston rod 14. A steel washer 22 which is mounted on the portion of the piston rod of reduced diameter separates the locking nut 21 from an annular piston head member 23 formed of a resilient material such as nylon which piston head member 23 is also mounted on the portion 20 of the piston rod of reduced diameter. The piston head member 23 has a divergent circumferential flange or peripheral skirt 24 which, in the normal (i.e. undeformed) position thereof, extends from the annular member towards the outlet. Four evenly spaced circular apertures 25 are formed in the piston head member for a reason which will be described hereinafter in greater detail. The piston head member 23 is mounted on the portion 20 of the piston rod of lesser diameter in such a manner that the piston head member 23 may slide along the piston rod between two terminal positions. A central aperture 26 is provided in the piston head member 23 and the portion 20 of the piston rod 14 extends through the aperture 26.

Mounted between the piston head member 23 and the portion of the piston rod 14 of greater diameter is a backing washer or sealing member 27 which is formed of steel and is separated from the portion of the piston rod of greater diameter by a nylon washer 28. The backing washer 27 is an annular member provided with a circular ridge 29 formed adjacent the periphery on the face thereof adjacent the piston head member 23. The ridge 29 defines a knife edge and is adapted to engage with a portion of the piston head member 23. The backing washer is of less overall diameter than the internal diameter of said sleeve 5.

The piston head assembly 9 is adapted to operate as a mechanical inlet valve, as will be described hereinafter in greater detail.

The end of the piston rod 14 remote from the piston head assembly 9 as above described is provided with a screw threaded portion to permit the same to be coupled to a reciprocating rod or rocking lever moved in response to movement of a driving assembly. Such a driving assembly may take any suitable form such as a piston and cylinder assembly or any suitable motor or engine.

The piston rod bearing 13 is dimensioned and located to permit the piston head assembly 9 to lie, in a withdrawn position, clear of the inlet aperture 2 and remote from the sleeve 5 and outlet 12, with the inlet 2 located between the piston head 9 and the sleeve 5.

Whilst a piston pump as hereinbefore described may be used simply for pumping material, the primary purpose of the pump is to pump very accurately predetermined quantities of material, such as very viscous or thixotropic materials.

The pump may be used either alone or in combination with other such pumps to provide relative proportioning of various materials. If the pump is to be used for pumping metered quantities of material, the dimensions of the piston cylinder and/or the length of the piston stroke are selected appropriately. When a plurality of metering pumps are used, the time of commencement of the metering displacement of each pump is important, and the sequence of operation of the mechanical valves constituted by the piston head assemblies may be controlled by controlling the time at which each piston head assembly passes the chamfered portion of the associated sleeve.

An operating cycle of the piston pump will now be described, assuming the piston head initially to be in a first or forward position in engagement with the flange defining the outlet of the cylinder.

The piston head 9 is first withdrawn along the cylinder sleeve from the first position, and while the piston head is being withdrawn in this manner the piston head member 23 will move until the central portion thereof is adjacent the steel washer 22 which separates the piston head member 23 from the locking nut 21. The piston head member 23 will thus be separated from the backing washer 27, as shown in FIG. 3, and since the diameter dimension of the backing washer 27 is less than the internal diameter of the sleeve 5, material will flow past the peripheral edge of the backing washer 27 and through the apertures 25 formed in the piston head member 23 into the sleeve 5, as the piston moves backwardly. Thus no partial vacuum is generated within the sleeve 5, or if any partial vacuum is generated the partial vacuum is only of little strength, since material is drawn into the sleeve as the piston head is withdrawn from the sleeve.

Because of the presence of the non-return valve in the outlet 12 when the piston is withdrawn no material is drawn into the cylinder from the outlet by the piston.

The piston is withdrawn until the piston head 9 has moved past the inlet 2, this being the position shown in FIG. 1, and then the direction of the movement of the piston rod 14 is reversed. The piston head member 23 engages the material to complete loading of the metering cylinder 5 should the metering cylinder not be fully charged already, and dependent upon the viscosity of the material, the piston head member 23 may move towards the backing washer 27 until the knife edge defined on the circular peripheral ridge 29 provided on the backing washer engages with the back surface of the piston head member 23, thus sealing the channel extending through the piston head member 23 defined by the apertures 25 therein. The piston head continues to move towards the cylinder 5 until the peripheral skirt 24 provided on the piston head member 23 engages with the chamfered region 8, this being the position shown in FIG. 2. At this point, the resistance of this engagement creates a mechanical sealing action between the piston head member 23 and the knife edge provided on the backing washer 27, ensuring that a firm seal is made between the piston head member 23 and the backing washer 27, and the knife edge cuts through any particles which may be present. The piston head assembly 9 thus acts as a mechanical inlet valve. The piston skirt 24 is edged slightly inwards as the piston head assembly passes the chamfered region 8 thus ensuring that the peripheral skirt 24 defines an adequate seal whilst in engagement with the cylindrical inner surface of the sleeve 5. It will be appreciated that the quantity of material contained within the sleeve 5 at the point when the peripheral flange 24 engages with the chamfered portion 8 thereof may be accurately determined, since at this point, if not before, the piston head member 23 is brought into sealing engagement with the backing washer 27 and on each stroke of the pump an accurately predetermined quantity of material may be expelled through the outlet. The quantity of material expelled through the outlet may be controlled by adjusting the length of the stroke of the pump.

The volume within the body in the vicinity of the aperture 2 constitutes a reservoir which becomes filled, or partially filled as a result of material being drawn into the body. As the piston head moves from the withdrawn position across the inlet aperture towards the sleeve 5, traversing said material filled region, it collects sufficient additional material to ensure that the sleeve 5 is completely full. The sleeve 5 may be substantially (or possibly completely) full solely as a result of the material entering the sleeve during the return stroke of the piston. Thus a greater and rapid complete loading of the cylinder 5 is ensured. As the piston head assembly 9 moves forwards towards the sleeve 5 it tends to draw further material down through the inlet aperture into the said reservoir.

When the piston head assembly 9 enters the sleeve 5 the skirt 24 of the piston head member 23 engages the inner wall of the sleeve 5 and serves as a mechanically operated nonreturn valve preventing the flow of material from the interior of the sleeve 5 to the region behind the piston head member 23 and thus the compression stroke of the pump formally commences and the metered volume of material in the sleeve is discharged through the outlet 12.

The non-return valve at the outlet 12 could be of the kind which opens automatically for a predetermined part of the compression stroke of the pump, but expediently, and in this particular embodiment, the valve operates on a pressure differential principle. The valve is, of course, closed during withdrawal of the piston head.

It will be understood that the single pump described hereinbefore may be mounted in any suitable manner and also it will be understood that a material dispensing apparatus may be formed by using either one, or more than one, such pump. If two or more pumps are utilised, the piston rods may be connected to a single operating rod which may be adapted to be moved to move all the piston rods by an equal distance, or to move the piston rods of different pumps by different distances to enable the various pumps to discharge different predetermined quantities of materials to be pumped thereby. Alternatively, pumps of different capacities could be utilised. Thus if three pumps are utilised, the piston rods of each pump may be pivotally coupled at spaced positions to a rockable lever, which itself may be pivoted at one end to a fixed point. The opposite end of the lever may be connected to a crank moved by a motor. Whilst three such pumps may be of identical dimensions, the output of the pump having the greatest length of stroke, which will be determined by the location of the pivotal connection of its piston rod with respect to the pivot point of the rockable lever, will have the greatest output. In practice such an arrangement enables the use of a small range of standardised pumps to be utilised in metering or dispensing apparatus to dispense a wide range of volumes of material, the apparatus being versatile insofar as pumping ratios may be readily and very accurately changed by altering the location of the connections between the piston rods and the rockable lever, thus controlling the times at which the piston head assemblies pass the chamfered regions of the respective cylinders. Output volumes may be changed whilst retaining relative ratios merely by changing the location of the lever pivot point.

Of course, it will be appreciated that a pump in accordance with the present invention may be double acting, a piston rod being provided with two piston head assemblies each adapted to co-operate with a separate sleeve.

Pumps, and apparatus incorporating one or more of such pumps, in accordance with this invention can be used to dispense a very wide variety of materials, for example, material having a range of between 1 and 1 million CPS.

Such pumps are particularly suitable in industry for dispensing liquids and semi-solids (e.g. pastes) such as epoxy resins, polyurethanes, polysulphides, silicones, and polyesters and also other materials such as matic materials, sealants, adhesives, greases and other lubricants, inks and plastisols. Furthermore the pumps may be used in conjunction with ancillary equipment, material supply vessels, material temperature control equipment and, where a plurality of pumps are used, with mixing equipment.

Pumps in accordance with a preferred embodiment of the invention, and apparatus incorporating one or more of such pumps, have many commercial advantages being simple, efficient and reliable in operation, thus reducing skilled labour costs and speeding production by eliminating operator erros whilst also minimising wastage and material handling hazards, for example health hazards.

It will be appreciated that whilst the invention has been specifically described with reference to a preferred embodiment in which the piston head member is movable relative to the piston rod whilst the sealing member is fixedly secured to the piston rod, in another embodiment of the invention the piston head member may be fixedly secured to the piston rod whilst the sealing member is movably mounted thereon. In such an embodiment the sealing member would be located adjacent the side of the piston head member closest to said outlet. In such an embodiment the sealing member would move solely in response to the pressure of the material being pumped, since the sealing member would not contact the chamfered region of the cylinder. Thus such an embodiment, whilst having certain uses, may prove to be as satisfactory as the first described embodiment of the invention.

I claim:

1. A material dispensing and metering piston pump comprising, in combination:

1. a cylinder having an axis and defining a chamber receiving the material to be dispensed and metered, the cylinder defining
   a. an inlet for the material,
   b. an outlet for the material axially spaced from the inlet, and c. a coaxial cylindrical metering portion extending in the cylinder chamber from the outlet towards the inlet, 2. a non-return valve in the outlet, and 3. a piston mounted for axial reciprocation in the cylinder chamber between a first terminal position in the metering portion adjacent the outlet and a second terminal position adjacent the inlet, the piston comprising a. a piston rod and b. a piston head mounted on the piston rod, the piston head including a first member having a peripheral skirt projecting in an axial direction towards the outlet and having a diameter corresponding to that of the metering portion for sealing engagement between the peripheral skirt and the metering portion, the first piston head member defining at least one axially extending aperture therethrough and being mounted for free axial movement on the piston rod between a first axial position and a second axial position, and a second member having a diameter smaller than that of the metering portion and being fixedly mounted on the piston rod adjacent the second axial position, the sealing engagement between the peripheral skirt and the metering portion holding the first piston head member in the first axial position spaced from the second piston head member upon axial movement of the piston away from the outlet and out of the metering portion, whereby the material in the chamber may flow between the piston head members and through the aperture, means on the piston rod for supporting the first piston head member on the piston rod during the axial movement of the piston away from the outlet, and axial movement of the piston towards the outlet and the metering portion causing the peripheral skirt to engage the metering portion and thus to move the first piston head member axially into the second position whereby the second piston head member seals the aperture and prevents flow of the material therethrough into the metering portion, one of the piston head members having a circular ridge defining a knife edge and the other piston head member having a corresponding circular recess for sealing engagement between the knife edge ridge and recess when the first piston head member is in the second axial position.

* * * * *